United States Patent [19]

LeBlanc

[11] 4,203,482

[45] May 20, 1980

[54] PROCESS FOR PRODUCING CORE OR MOLD PARTS FROM SAND

[76] Inventor: Leo J. LeBlanc, 3837 Shellmar La., Bloomfield Hills, Mich. 48013

[21] Appl. No.: 881,770

[22] Filed: Feb. 27, 1978

[51] Int. Cl.[2] ..... B22C 9/12; B22C 15/00

[52] U.S. Cl. ..... 164/12; 164/40

[58] Field of Search ..... 164/6, 12, 15, 16, 23, 164/27–29, 37, 40, 45, 192–194, 207, 210–212

[56] References Cited

U.S. PATENT DOCUMENTS

| | | | |
|---|---|---|---|
| 150,079 | 4/1874 | Reagan | 164/210 |
| 925,249 | 6/1909 | Taylor et al. | 164/40 |
| 3,406,738 | 10/1968 | Hunter | 164/194 X |
| 3,664,406 | 5/1972 | Mawson et al. | 164/40 X |

FOREIGN PATENT DOCUMENTS

| | | | |
|---|---|---|---|
| 20184 | 1/1883 | Fed. Rep. of Germany | 164/29 |
| 1016905 | 10/1957 | Fed. Rep. of Germany | 164/16 |

*Primary Examiner*—Robert D. Baldwin

*Assistant Examiner*—J. Reed Batten, Jr.

*Attorney, Agent, or Firm*—Basile and Weintraub

[57] ABSTRACT

The improved process comprises placing in an open top, walled enclosure a pattern plate carrying the pattern for the core or mold part to be produced. The height of the pattern plate is adjustable relative to the tops of the walls of the enclosure so that when sand coated with a polymerizable resin is poured onto the top of the pattern the excess sand flows over the tops of the walls, covering the pattern with a mound of sand the slope of the walls of which is determined by the angle of least repose of the sand. A squeeze head having a surface corresponding to the surface of the pattern is now pressed downwardly onto the top of the pile of sand, to compact the sand about the pattern. While thus held by the squeeze head, material such as gas is passed from the bottom of the mold or core up through the now compacted sand, thus to polymerize the resin. The squeeze head is removed and the now cured, resin sand core or mold part is removed, ready for use in the usual way.

3 Claims, 9 Drawing Figures

PROCESS FOR PRODUCING CORE OR MOLD PARTS FROM SAND

This invention relates to the production of useful core or mold parts from sand for use in the foundry art.

My invention has for an object the provision of a process by which sand cores or mold parts may be easily and accurately produced with a minimum of time and expense and using only the optimum amount of resin coated sand for the part to be produced.

More specifically, my invention contemplates the production of core or mold parts which comprises mounting the pattern for the part on a pattern plate, supporting the thus mounted pattern and its plate within an open top, walled enclosure, pouring resin coated sand downwardly onto the top of the pattern in such an amount that it overflows the side walls of the confining box or enclosure; then bringing downwardly onto the sand thus piled upon the pattern a squeeze head having surfaces which generally conform to the upper surfaces of the pattern, thus to compact the sand, and while holding the squeeze head down, curing the resin by gasing or otherwise.

My invention contemplates the provision of core or mold parts in which the thickness of the part may be varied at will, thus economizing on the resin-coated sand, assuring at one and the same time the production of parts which are strong enough for the job at hand and yet which are not so thick as to waste the relatively expensive resin with which the sand is coated.

Briefly, my invention comprises an improved process for making sand cores or sand mold parts which comprises placing the pattern on a pattern plate or the like. The pattern plate is now supported at a predetermined distance below the tops of closely surrounding walls, the distance below the tops of the walls being determined by the desired or required thickness of the sand of the finished core or mold. With the pattern mounted on the pattern plate and positioned at the required distance below the level of the tops of said walls, the resin-coated sand is now poured onto the pattern preferably until it overflows the tops of the walls of the box in which the pattern and plate are mounted. This results in a mound of sand over the pattern the slope of the walls of which is determined by the angle of least repose of the coated sand particles in the mass. A squeeze head, preferably having overall dimensions to fit snugly within the confines of the walls of the box in which the pattern plate and pattern are contained and which also has a shape on its lower surface corresponding to the shape of the pattern, is now pressed downwardly on top of the sand, thus to compact the sand. With the squeeze head in place, gas or other curing agent for the resin is passed through the sand body to cause the resin to polymerize, thus to form the solid body of the core or mold part as is known in the art. Instead of using gas to cure the resin, the resin-coated sand may incorporate a catalyst operable to cure the resin by the passage of time. The head is now withdrawn and the part is removed, completing the operation.

A form of apparatus suitable for carrying out my improved process is illustrated in the accompanying drawings forming a part hereof in which.

Figure 1:
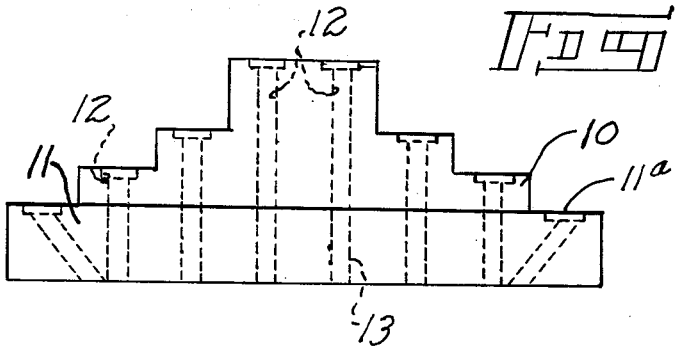
FIG. 1 is a side elevational view of a pattern plate and pattern mounted thereon.

Referring now to the drawings for a better understanding of my invention in FIG. 1 I illustrate at 10 a pattern which is mounted in any suitable fashion upon a pattern plate indicated at 11. It will be understood that the pattern and pattern plate have communicating openings 12 and 13 therein through which a suitable gas may be passed to cure the resin which coats the grains of sand as will be explained.

Figure 2:
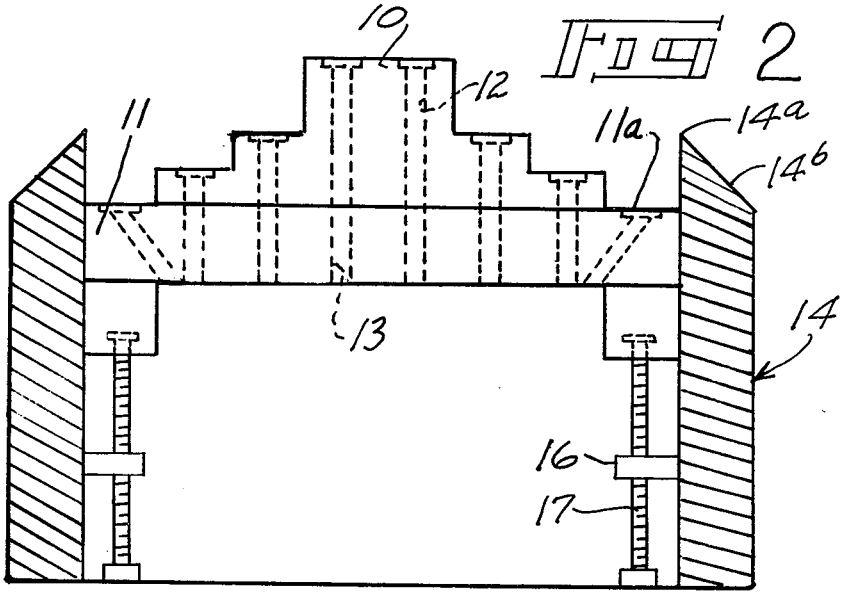
FIG. 2 is a view of the pattern plate and pattern supported with the level of the pattern plate lying at a predetermined desired distance below the tops of the walls of a confining box.

In FIG. 2 I illustrate the pattern and pattern plate shown in FIG. 1 as being positioned within a confining box-like structure 14. As further will be understood the pattern plate may be square, rectangular, round or other shape and the box 14 is built so as to snugly receive the pattern plate. For convenience, the box may be equipped with lugs 16 threaded to receive screws 17. The screws 17 may carry at their upper ends enlarged blocks or the like 18 on which the pattern plate 11 is supported. The height of the top 11$^a$ of the pattern plate may thus be adjusted relative to the height of the tops 14$^a$ of the walls of the box 14. Any suitable form of adjusting mechanism may be employed.

Figure 3:
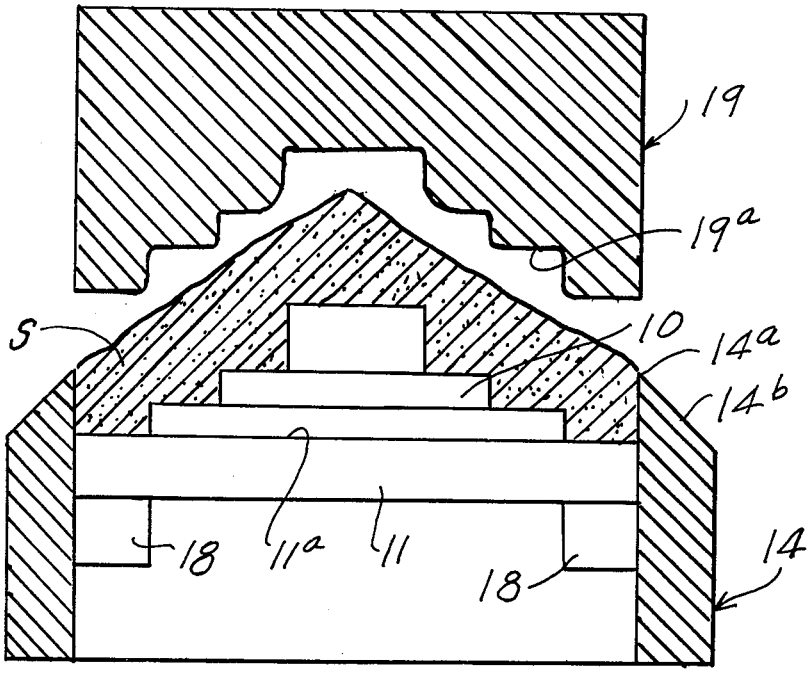
FIG. 3 is a vertical sectional view illustrating the presser head about to be applied to the mound of resin-coated sand which has been poured over the pattern and plate.

With the pattern plate carrying the pattern mounted at a desired height below the tops 14$^a$ of the walls of the box 14, a quantity of sand indicated in the drawings by the letter S is now poured over the pattern and plate as shown in FIG. 3. Preferably, the height of the top surface 11$^a$ of the pattern plate 11 relative to the tops 14$^a$ of the walls of the box 14 is such that when sand is simply poured on top of the pattern it overflows or runs over the walls. The thickness of the sand at the thinnest part is thick enough to produce a useable part. Further, when sand is thus poured to overflowing over the wall tops 14$^a$, the sand forms a conical mound the slope of the walls of which is determined by the angle of least repose of the coated sand.

With the process carried out to the extend indicated in FIG. 3 I am now ready to compact the sand. To this end I provide a squeeze head 19 having a surface 19$^a$ corresponding generally to the surface of the pattern 10. Conveniently, the squeeze head 19 may be formed prior to pouring the sand simply by placing on the top surfaces of the pattern 10 a moldable material such as one of the epoxy materials and then stripping it away, thereby to provide a squeeze head 19 having correctly shaped surfaces 19$^a$ corresponding generally to the pattern 10.

Figure 9:
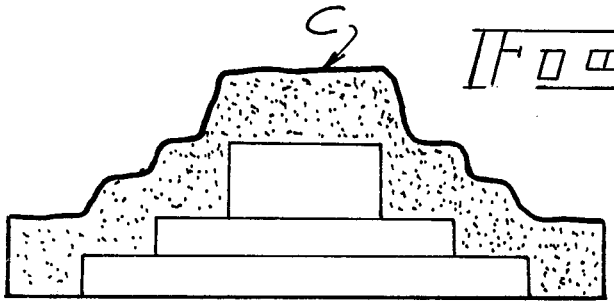
Figure 4:
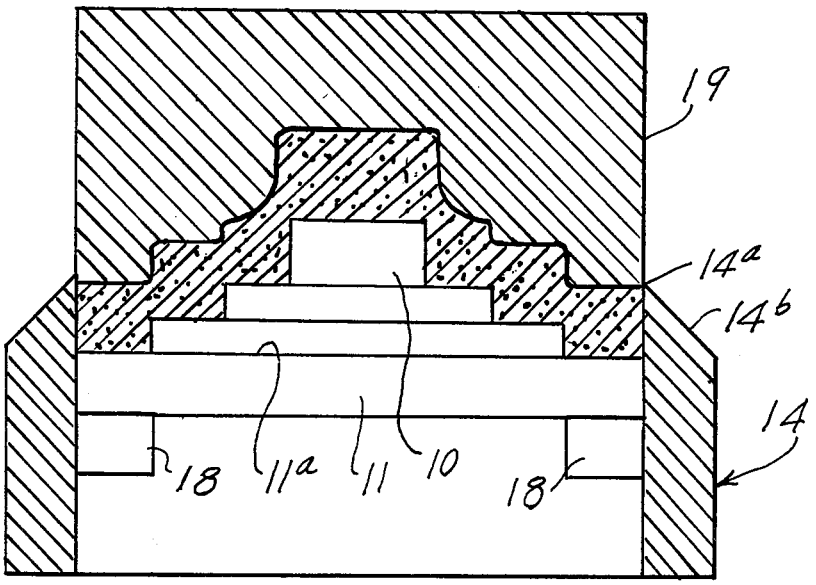
FIG. 4 is a view showing the presser head in the position of final compaction of the sand.
Figure 5:
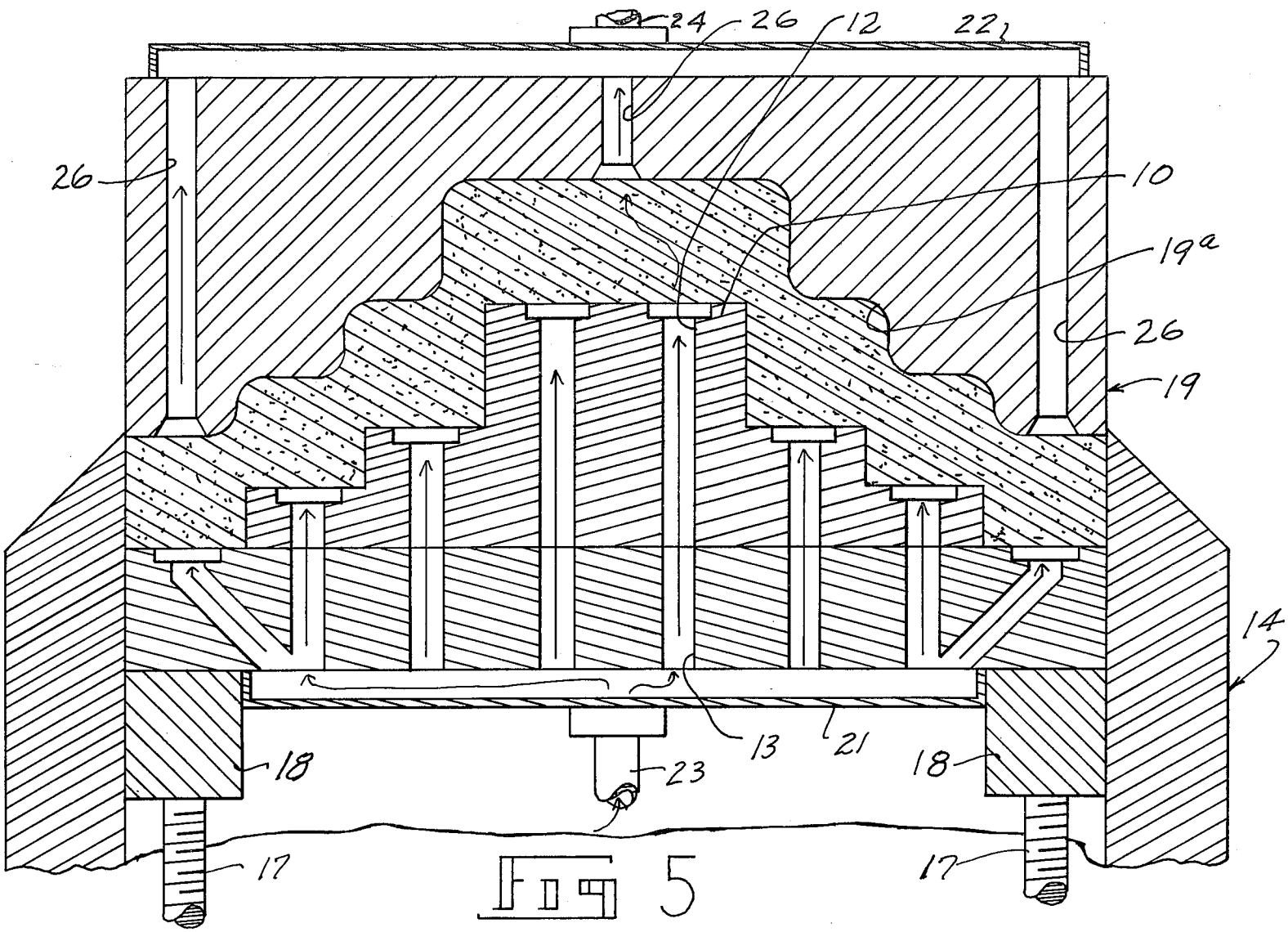
FIG. 5 is a somewhat enlarged vertical sectional view illustrating the method of gasing the sand to cure the resin which coats the grains thereof.

With the parts in the position of FIG. 3 the squeeze head is now pushed downwardly under pressure to the position of FIG. 4, compacting the sand. A hood 21 is located beneath the pattern plate and another hood 22 is secured to the top of the squeeze head 19. See FIG. 5. With the hoods thus in place a suitable gas is introduced through a conduit 23 into the hood 21 and suction is applied to a conduit 24 4 in the hood 22. The gas passes upwardly through the openings 13 and 12 into the sand where it polymerizes the resin which coats the grains of sand. The gas passes upwardly from the sand through suitable openings 26 in the squeeze head 19. The squeeze head is now removed and the core part C indicated in FIG. 9 is removed and is ready for use. As is known, instead of curing the resin with gas, it may be done by incorporating with the resin a suitable catalyst which cures the resin merely by the passage of time.

Figure 6:
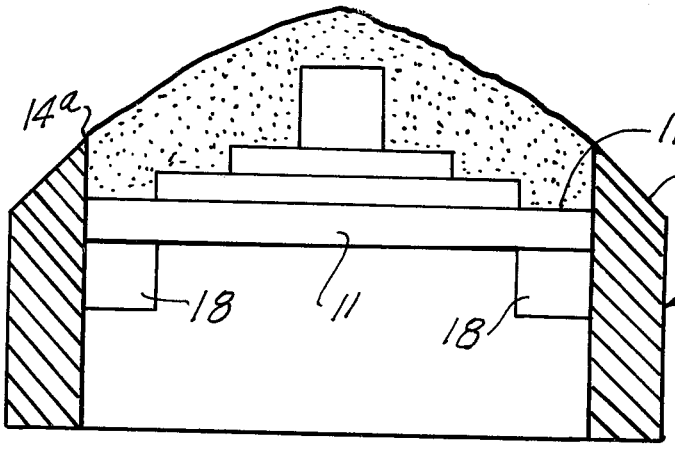
FIGS. 6, 7 and 8 are vertical sectional views through a pattern plate, pattern and box showing how the thickness of the sand for a mold part may be varied by varying the distance between the top of the pattern plate and the tops of the walls of the confining box; and, FIG. 9 is a vertical sectional view through a mold part formed by my improved process.
Figure 7:
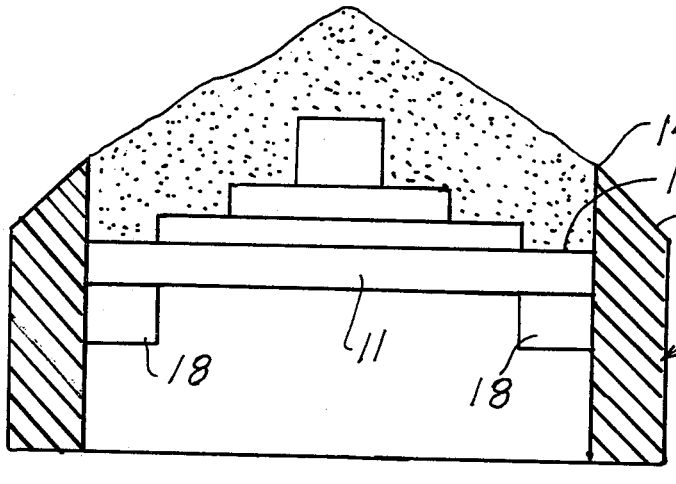
Figure 8:
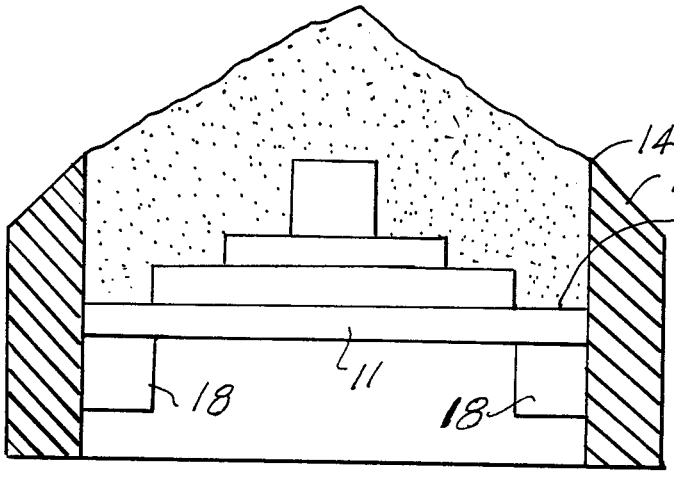

A feature of my invention is the fact that mold parts or other sand bodies for use in the foundry art may be formed of different wall thicknesses. Viewing FIGS. 6, 7 and 8 it will be seen that by positioning the top surface 11$^a$ of the pattern plate at different distances from the top edges 14$^a$ of the walls of the box 14, the thickness or height of the sand which covers the plate and pattern and whose upper height is determined by the angle of least repose of the sand as the sand overflows the top edges 14$^a$ of the wall may be varied. Thus, in FIG. 6 the sand is shown to be relatively thin; in FIG. 7 thicker, and in FIG. 8 still thicker. Therefore, by supporting the top of the pattern plate at a predetermined distance below the top edges of the walls 14$^a$, the optimum amount of resin-coated sand may be used for the particular part to be produced.

Throughout the drawings it will be noted that the top edges of the walls of the confining box are sloped as at 14$^b$ so that the upper edges 14$^a$ are fairly sharp pointed. The purpose of this is to permit the sand to spill freely over the tops of the walls of the box so that it will not build up on the tops of the walls.

In view of the foregoing it will be apparent that I have devised an improved process for making sand cores or mold parts for use in the foundry art. The squeeze head may be formed for each individual part to be produced by using the pattern 10 as a pattern for forming the squeeze head 19. There are many moldable materials which, in combination with a suitable filler between the head and pattern, can simply be poured in plastic form onto the top of the pattern 10, solidified, removed, and used as the presser head. Thus, the squeeze head itself is quite easily produced for each individual job, requiring no machining inasmuch as the shape of the surface 19$^a$ need only approximate the shape of the pattern. Furthermore, in the event the finished mold part is too thin in given areas all one has to do is to cut away the squeeze head in that area so as to permit more sand to remain in that particular location between the squeeze head and the pattern.

My invention is particularly useful in the production of cope and drag sections of molds although it has utility in the production of cores and other resin sand bodies used in the foundry art. It will further be apparent that my improved process permits the production of resin sand parts in a very economical fashion and produces parts of good accuracy and of adequate strength for the purpose at hand. Excess sand which spills over the sides of the boxes 14 is reused in the process.

While I have shown my invention in but one form, it will be obvious to those skilled in the art that it is not so limited but is susceptible of various other changes and modifications without departing from the spirit thereof.

What I claim is:

1. The process of producing core or mold parts useable in the foundry art comprising:

(a) coating sand with a polymerizable resin in an amount which when polymerized binds the sand particles into a useable mass, (b) placing a pattern mounted on a pattern plate in a walled, open top enclosure with the top of the pattern plate at a predetermined distance below the tops of said walls, (c) covering the thus confined pattern with a mound of the resin-coated sand until said sand overflows the tops of said walls with the height of said sand mound with respect to the top of the pattern being determined by the angle of least repose of the coated sand and by the highest point of the pattern plate with respect to the tops of said walls, (d) pressing downwardly onto the sand mound overlying the pattern a squeeze head having a shape conforming generally to the shape of the pattern, thus to compact the sand about the pattern, and (e) polymerizing the resin in the thus compacted body thereby to produce a useable sand part having a casting surface corresponding to the pattern.

2. The process of claim 1 including the further step of covering the casting surface of the pattern with a removable, hardenable plastic-like material, thereby to produce said squeeze head having said shape which corresponds generally to the shape of the pattern.

3. The process of producing useable core or mold parts comprising:

(a) coating sand with a polymerizable resin in an amount which when polymerized binds the sand particles into a useable mass, (b) placing a pattern mounted on a pattern plate in an open top walled enclosure with the top of the pattern plate at a predetermined distance below the tops of said walls, (c) pouring the resin-coated sand onto the top of the pattern until it overflows said walls, thereby covering the pattern with a mound of sand the slope of which is determined by the angle of least repose of the coated sand particles, (d) pressing downwardly onto the sand mound overlying the pattern a squeeze head having a surface conforming generally to the shape of the surface of the pattern and of overall dimensions to fit snugly within said walled enclosure, thus to compact the sand about the pattern, and (e) polymerizing the resin in the thus compacted body while the squeeze head is in place, thereby to produce a useable part having a casting surface corresponding to the pattern.

* * * * *